US007264446B2

(12) United States Patent
Yoshida et al.

(10) Patent No.: US 7,264,446 B2
(45) Date of Patent: Sep. 4, 2007

(54) CENTRIFUGAL-FAN IMPELLER, AND METHOD OF ITS MANUFACTURE

(75) Inventors: Yusuke Yoshida, Kyoto (JP); Toru Tamagawa, Machida (JP); Tomotsugu Sugiyama, Kyoto (JP); Kazumi Takeshita, Kyoto (JP)

(73) Assignee: Nidec Corporation, Kyoto (JP)

( * ) Notice: Subject to any disclaimer, the term of this patent is extended or adjusted under 35 U.S.C. 154(b) by 180 days.

(21) Appl. No.: 10/907,437

(22) Filed: Mar. 31, 2005

(65) Prior Publication Data

US 2005/0220613 A1 Oct. 6, 2005

(30) Foreign Application Priority Data

Mar. 31, 2004 (JP) ..... 2004-101994
Feb. 9, 2005 (JP) ..... 2005-032495

(51) Int. Cl.
*F01D 5/00* (2006.01)

(52) U.S. Cl. ..... 416/187; 416/198 R; 416/241 A; 29/889.4

(58) Field of Classification Search ..... 29/889.4; 264/54.1; 416/187, 198 R, 241 A, 186 R
See application file for complete search history.

(56) References Cited

U.S. PATENT DOCUMENTS

| | | | | |
|---|---|---|---|---|
| 2,652,190 | A * | 9/1953 | Meltzer et al. | 416/187 |
| 3,201,032 | A * | 8/1965 | Gelbard | 416/187 |
| 3,257,071 | A * | 6/1966 | Harris | 416/187 |
| 3,306,529 | A * | 2/1967 | Nelson | 416/187 |
| 3,536,416 | A * | 10/1970 | Glucksman | 416/178 |
| 6,095,752 | A * | 8/2000 | Gronier et al. | 416/186 R |
| 6,893,220 | B2 * | 5/2005 | Eaton et al. | 415/206 |

* cited by examiner

*Primary Examiner*—Igor Kershteyn
(74) *Attorney, Agent, or Firm*—James W. Judge

(57) ABSTRACT

A tiny-diameter, lengthwise extensive impeller utilized in an ultra-small centrifugal fan is molded by an injection molding operation. In order to avert difficulties attendant on injection-molding ultra-miniature parts, the thickness and length of a reinforcing ring on the tip of the impeller are set to within predetermined ranges. Further, the thickness of each of the vanes that constitute the impeller is made maximum where they join to the impeller ring section.

11 Claims, 16 Drawing Sheets

CENTRIFUGAL-FAN IMPELLER, AND METHOD OF ITS MANUFACTURE

BACKGROUND OF THE INVENTION

1. Technical Field

The present invention relates to methods of manufacturing impellers for centrifugal fans, and to centrifugal fans as well.

2. Description of the Related Art

Device downsizing and performance upgrading of electronic equipment in recent years have entailed demands for the scaling down of cooling fans installed in such electronic devices. As one among such attempts, a centrifugal fan in which the impeller has been reduced in diameter, and the individual vanes constituting the impeller have been thinned and arranged at a denser spacing has been proposed.

Meanwhile, inasmuch as centrifugal-fan impellers have traditionally been manufactured by injection molding, various techniques for enhancing the quality of the manufactured product have been developed. Examples of such techniques include a method in which in advance of infusing a mold with thermoplastic resin, the mold is evacuated, as well as a method in which excessive exhausting of gases during the molding operation is prevented by sufficiently drying the thermoplastic material beforehand and then melting it. Another example utilizes highly fluid liquid crystal polymers as base materials to make it possible to mold impellers having longer vanes.

Nevertheless, to proceed to make the vanes thinner is to make it impossible to mold an impeller stably by traditional methods. In particular, designing the individual vanes of a centrifugal fan to be both thinned and elongated in order to improve the fan's performance would make it impossible to charge the inside of the mold sufficiently with thermoplastic resin.

Centrifugal-fan impellers are sometimes furnished with a ring section that links the tips of the vanes. The objective in such configurations is to enhance the impeller rigidity by tying the vane tips together. The ring section is vital to implementations in which an impeller is axially extensive and its vanes are thin. For ultra-miniature centrifugal fans (e.g., centrifugal fans whose outer diameter is 25 mm or less), however, if an impeller having a ring section is to be injection molded, the flow of thermoplastic resin inside the mold would be restrained such that the ring-forming portion of the mold could not be charged sufficiently with the resin. Or, even if it could be thus charged, then meld lines would form in the ring area, deteriorating the strength of the ring section. Such phenomena are detrimental to throughput during production, and invite increases in post-manufacturing breakage.

BRIEF SUMMARY OF THE INVENTION

An object of the present invention, brought about in order to resolve the problems discussed above, is to make available a method of manufacturing, by injection molding and at high throughput, impellers for micro-diameter centrifugal fans—in particular, impellers whose axial length has been extended in order to improve the impeller's characteristics.

In the present invention, in order to heighten throughput in the injection-molding manufacture of ultra-miniature impellers for centrifugal fans, the thickness of the ring section is secured, and at the same time a fixed or greater axial length for the ring section is secured. In this way securing the dimensions of the ring facilitates the flow of the thermoplastic resin in the area of the mold interior that corresponds to the ring.

The causative factor behind deterioration in the strength of the ring section in ultra-miniature impellers originates in insufficiency in the flow of thermoplastic resin into the ring-forming portion of the mold, which makes it likely that meld lines will form. In the present invention, the thickness and length of the ring section are rendered fixed dimensions or greater in order to avert this problem. Doing so keeps meld lines from forming within the ring-forming portion of the mold to enhance the strength and durability of the ring section, even in impeller molding implementations in which the gate is positioned in the end of the mold opposite the ring section. In a further aspect of the present invention, the formation of meld lines is also held in check by increasing the vane thickness in the area in which the vanes connect to the ring section.

Such improvement is particularly pronounced in implementations in which thermotropic liquid-crystal polymers are employed as the base material-implementations that are especially vulnerable to strength deterioration where the polymer melds.

When an ultra-miniature impeller as described above is to be molded in an injection mold, in addition to sufficiently drying the thermoplastic resin base material beforehand, the inside of the mold must be evacuated during the molding operation. The evacuation port is advantageously provided along the rim of the vanes, in the end of the mold opposite its gate. For example, the port can be provided in the lateral surface of the cavity that corresponds to the ring section, or in the vicinity of the borderline between the ring section and the vane tips.

In order to make the flow of thermoplastic resin inside the ring-forming portion of the mold more definite and reliable, the resin may be forced out through the evacuation port and then cut off.

As another means of enhancing the strength of the ring section, a ring-shaped element formed from metal or other suitable material may be placed into a position inside in the mold equivalent to the ring section and then the thermoplastic resin infused into the mold. Exploiting such an insert-molding technique also contributes to enhancing the strength of the ring section of an ultra-miniature impeller.

From the following detailed description in conjunction with the accompanying drawings, the foregoing and other objects, features, aspects and advantages of the present invention will become readily apparent to those skilled in the art.

DETAILED DESCRIPTION OF THE INVENTION

Figure 1:
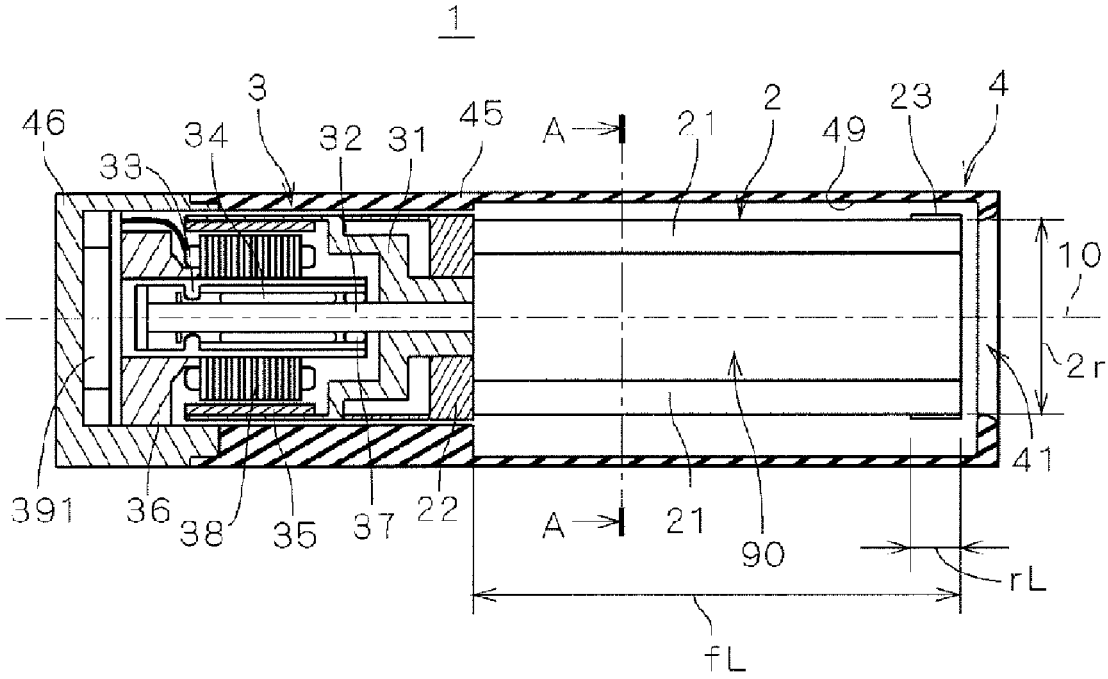
FIG. 1 is a vertical section view illustrating a centrifugal fan involving a first embodiment of the present invention.
Figure 2:
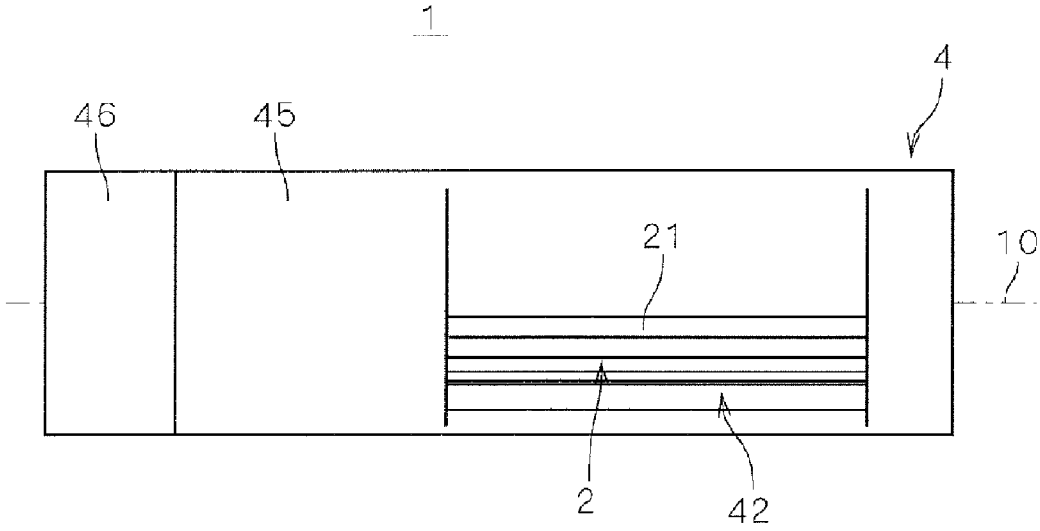
FIG. 2 is an elevational view representing the centrifugal fan.

Reference is made to FIG. 1, which is a diagram illustrating the configuration of a centrifugal fan 1 involving a first mode of embodying the present invention and represents a vertical section sliced along a plane containing the fan's center axis 10. Reference is also made to FIG. 2, which is an elevational view of the centrifugal fan 1, and to FIG. 3, which is a transverse view of the centrifugal fan 1 in section along the arrow-indexed locus A-A.

The centrifugal fan 1 is an electromotive fan utilized in order to air-cool electronic parts in the interior of electrical products and electronic devices (portable articles in particular). The centrifugal fan 1 is equipped with: an impeller 2 that by rotating generates a flow of air; a motor 3 for rotating the impeller 2; and a housing 4 for housing the impeller 2 and the motor 3, and that controls the flow of air generated by the rotation of the impeller 2, sending the air outside the fan.

The impeller 2 is approximately round-cylindrical in external form, and is furnished with: a plurality of vanes 21 for generating a flow of air; a connector section 22 for linking together and anchoring the motor-ward ends of the plurality of vanes 21, and being the impeller end that connects to the motor 3; and an approximately round cylindrical reinforcing ring 23, fixed to the vane ends on the side of the plurality of vanes 21 that is opposite the connector section 22, that reinforces the linkage of the vanes 21. The plural vanes 21, the connector section 22, and the reinforcing ring 23 are molded unitarily from a thermoplastic resin.

Figure 3:
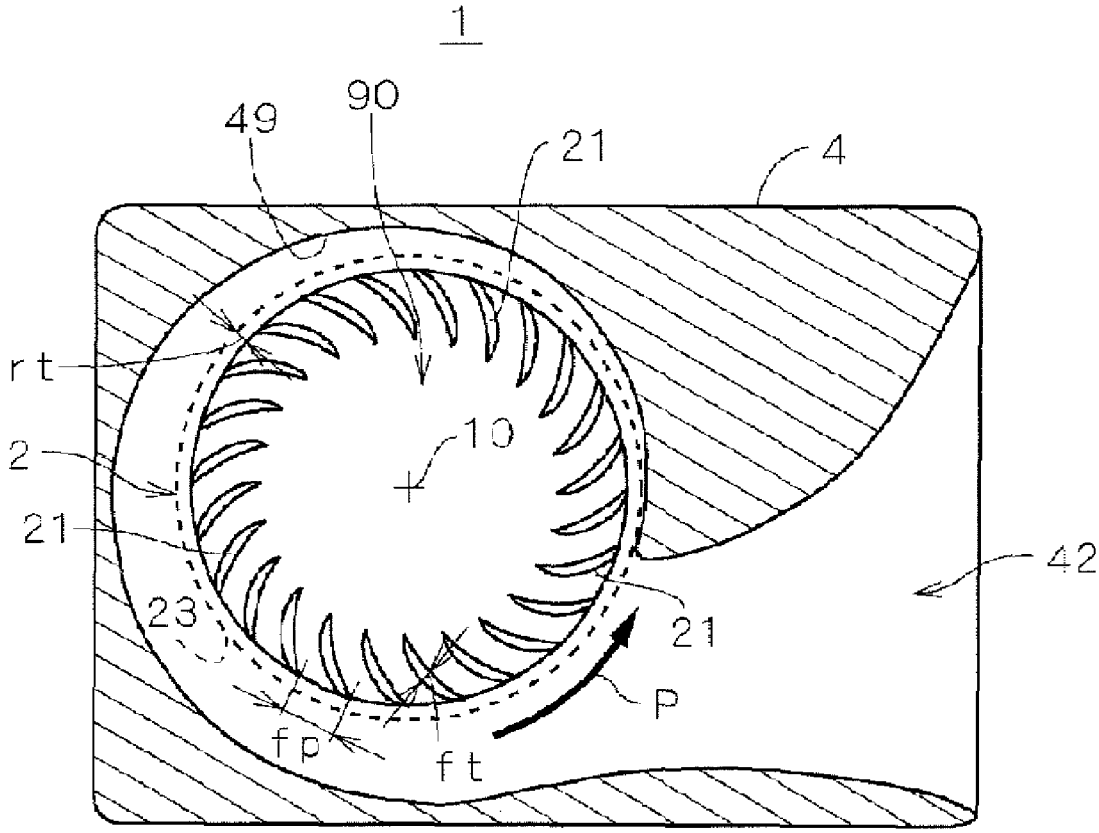
FIG. 3 is a transverse sectional view depicting the centrifugal fan.

As shown in FIG. 3, the plurality of vanes 21, at a fixed distance from the impeller center axis 10, is arrayed encompassing the center axis 10, with the vanes spaced apart at a set pitch fp; and as indicated in FIG. 1, the vanes each extend parallel to the center axis 10. When the motor 3 spins, air flows through the reinforcing-ring 23 end of the impeller, into an interior space 90 that is enveloped by the plurality of vanes 21. This means that in the impeller 2, the reinforcing ring 23 constitutes the rim of an opening through which air is led into the space 90. The connector-section 22 end of the space 90 is closed off by the connector section 22 being connected to the motor 3.

The housing 4 is, as shown in FIGS. 1 and 2, composed of a housing main unit 45 that houses the impeller 2 and the principal components of the motor 3 (as far as the environs of the motor's stator 38), and a cap 46 that fits snugly into the housing main unit 45. An air inlet 41 and a venting port 42 are provided in the housing main unit 45.

In a centrifugal fan 1 having the configuration just described, when the impeller 2 spins, air flows into the space 90 through the air inlet 41 and flows out from between the plurality of vanes 21, traveling along the inner surface 49 of the housing 4, and is sent out through the venting port 42.

Herein, the outer diameter 2*r* of the impeller 2 (r being the radius) illustrated in FIG. 1 is no more than 25 mm, with the length fL of the plurality of vanes 21 in terms of their extent along the center axis 10 satisfying the relation $2 \leqq fL/r \leqq 20$. In this embodiment, the outer diameter 2*r* is 12 mm, and the length fL is 27 mm (wherein the reinforcing ring length rL is 4 mm). It should be understood that although the working length of the vanes 21, being fL−rL, is shortened owing to the extent taken up by the axial length of the ring section, in the present invention, because fL is large, performance degradation from the deficit in working vane length owing to the presence of the ring section is negligible. It should also be understood that the outer diameter 2*r* of the impeller 2 is defined as not including the thickness rt, as indicated in FIG. 3, of the reinforcing ring 23.

In the impeller 2, by the relation $2 \leqq fL/r$ being satisfied the point of maximum flow speed of the air flowing out from between the plurality of vanes 21 is put in the vicinity of midway between the two ends of the vanes 21. The flow volume of air is increased as a result, enabling the generation of a highly efficient flow of air. At the same time, by $fL/r \leqq 20$ being satisfied, vibration is held down even at rotating speeds of more than 10,000 rpm, (for example, 20,000 rpm). The configuration is thus favorable to revving the fan at high rpm, whereby the flow volume and static pressure of the air can be heightened all the more.

Figure 4:
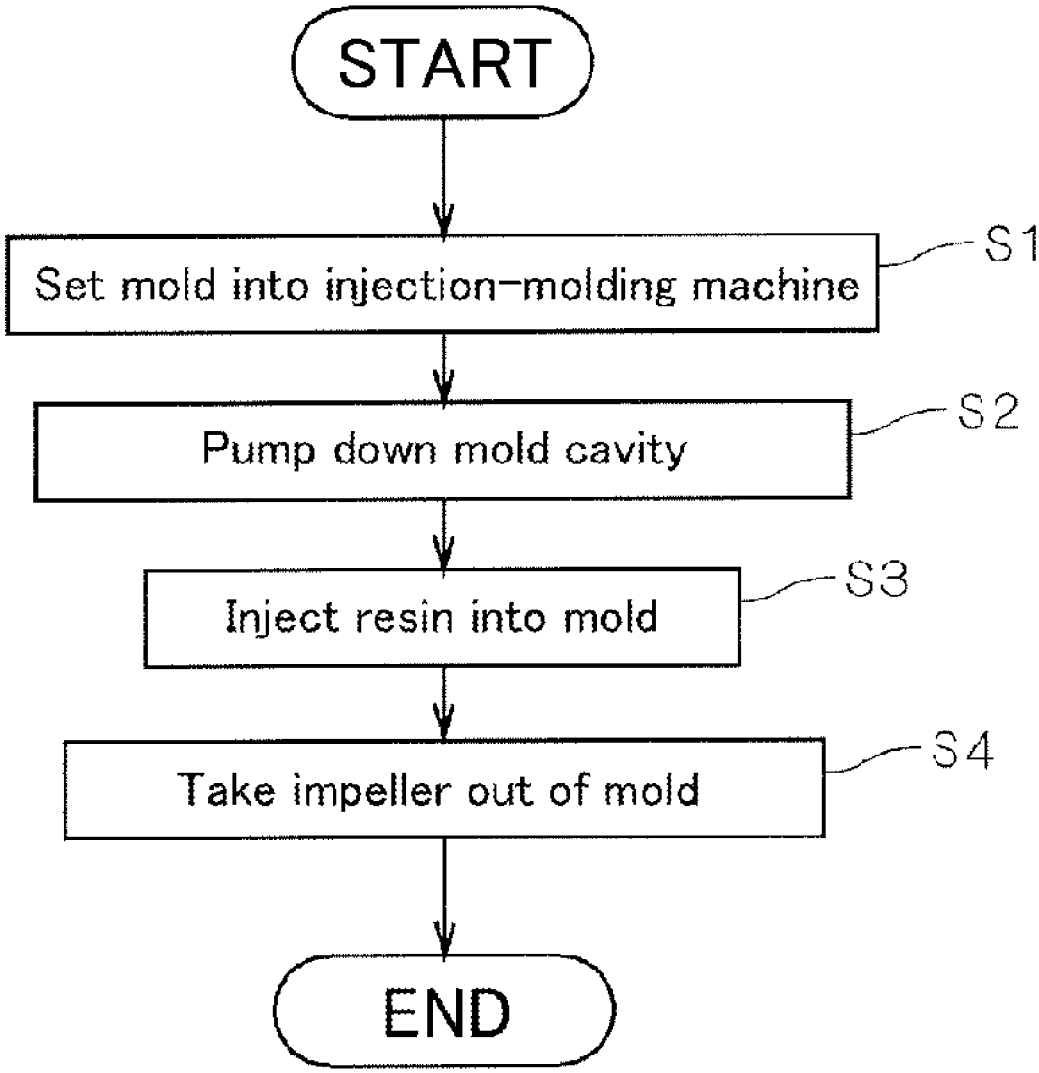
FIG. 4 is a chart setting forth process flow in the manufacture of an impeller by injection molding.
Figure 5:
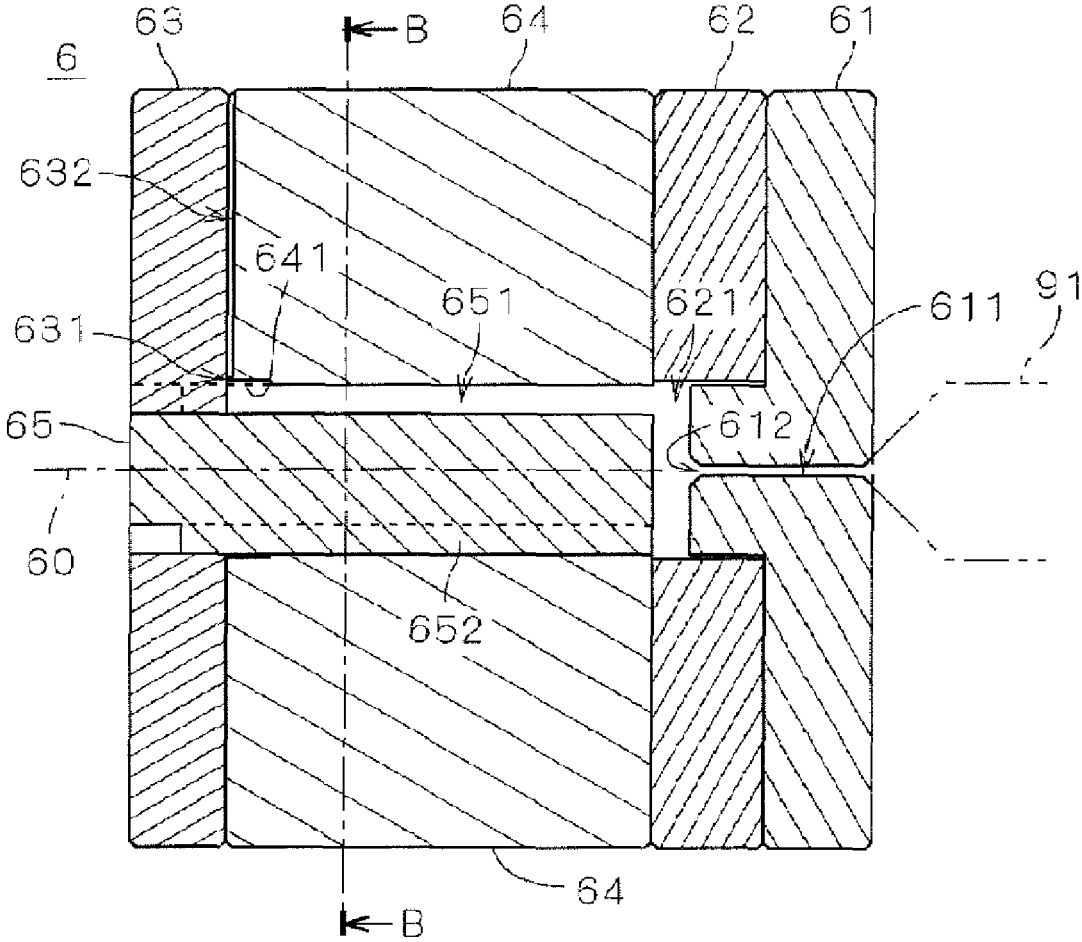
FIG. 5 is a sectional view of a mold.

Reference is now made to FIG. 4, which is a chart setting forth process steps to manufacture for the centrifugal fan 1 an impeller 2 having fine, long vanes 21 by injection molding. In manufacturing the impeller 2, at first preparations are made by setting a mold having a cavity, which is an interior space made to match the shape of the impeller 2, into an injection-molding machine (step S1). Reference is further made to FIG. 5, which is a sectional view illustrating the structure of the mold 6, and to FIG. 6, which is a diagram illustrating a portion of a sectional plane through the mold 6, along the arrow-indexed locus B-B in FIG. 5. The orientation of the impeller that would be molded in FIG. 5 is right-left reversed from the orientation of the impeller 2 illustrated in FIG. 1.

The mold 6 comprises: a first plate 61, to which a nozzle 91 of the injection-molding machine connects; a second plate 62 in contact with the left side of the first plate 61; a third plate 63 that is located on the leftmost side of the mold; two side blocks 64 in between the second plate 62 and the third plate 63, located above and below to enclose the cylindrical side of the impeller 2 being molded; and a core 65 inserted into the approximately round cylindrical space flanked by the two side blocks 64.

Figure 6:
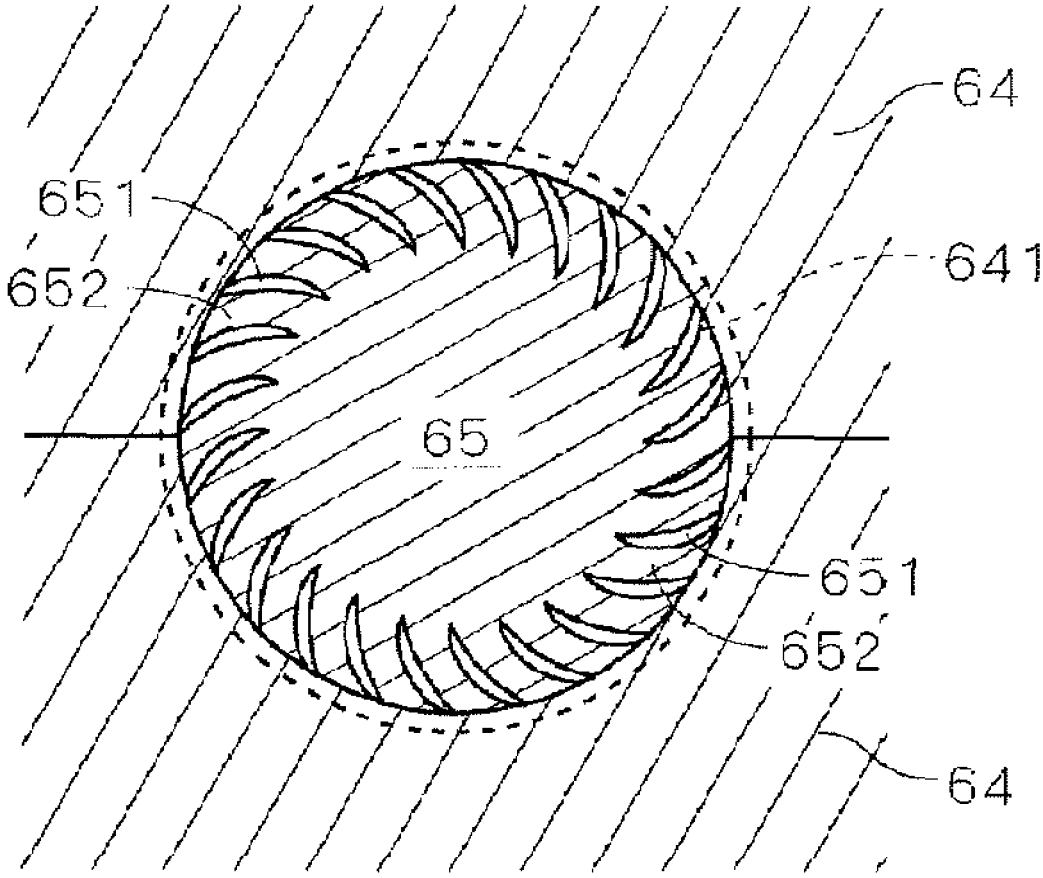
FIG. 6 is a view depicting a portion of the mold in section.

A flowpath 611 through which thermoplastic resin ejected through the nozzle 91 passes is formed in the first plate 61; the gate 612 in the end of the flowpath 611 corresponds to the center of the connector section 22 of the impeller 2. (The center of the impeller connector section 22 is actually where a hole is formed, through which the motor 3 is connected after molding—c.f. FIG. 1.) The second plate 62 has an inner-side surface that corresponds to the outer-side surface of the connector section 22, and forms a space 621 that corresponds to the connector section 22. As shown in FIG. 6, the core 65 is inserted into the space flanked by the two side blocks 64, wherein the core 65 creates a conformation corresponding to the space 90 inside the impeller 2 and to the spacings between the plurality of vanes 21 (c.f. FIG. 3). In FIGS. 5 and 6, the flutes in the core 65 that correspond to the vanes 21 are labeled with reference mark 651. It will be appreciated that in FIG. 5, on the upper side of the center line 60, depicted is a situation in which one of the flutes 651 is present, while on the lower side, depicted is a situation in which one of gill-like regions 652 (see FIG. 6) of the core 65, which are present between the plurality of flutes 651, is present. Furthermore, a recess that extends lengthwise with respect to the center line 60, and which corresponds to the reinforcing ring 23, is labeled with reference mark 641 in FIGS. 5 and 6.

The third plate 63 has an opening through which the core 65 is inserted/removed, and the right-side surface of the plate corresponds to the end face of the reinforcing ring 23, which is the rim of the opening in the impeller 2. In a position corresponding to the corner between the end face and lateral surface (a position pointing to the cylindrical surface) of the reinforcing ring 23—in particular, in a position that is between the third plate 63 and one of the side blocks 64 and is in one of the flutes 651—an evacuation port 631 is formed as a slight breach. The evacuation port 631 is connected to an evacuation passage 632 formed between the third plate 63 and the side block 64. The evacuation passage 632 is connected to an evacuating pump in the injection-molding machine. Along the opening for the core 65 in the third plate 63, grooves corresponding to the core's gill-like regions 652 are formed so that the core 65 can be extracted following an injection molding operation. Thus in this configuration, the flutes 651 in the core 65, which correspond to the vanes 21, are tangent to the inner-side surface of the side blocks 64; and twin walls of the grooves formed in the third-plate 63 opening through which the core 65 is introduced define projections that (where they correspond to the end faces of the vanes 21) close off the flutes 651.

Once the mold 6 has been set into the injection-molding machine, the evacuating pump is run to evacuate the mold 6 interior space—that is, the mold cavity—through the evacuation passage 632 to put the cavity into a vacuum state (step S2). Meanwhile, a pellet of thermoplastic source material, having been dried beforehand by heating the material 2.5 to 3 hours at 140-165° C. inside a drier under a reduced-pressure environment or under a predetermined gas environment, is fed from a hopper into the injection-molding machine, without prolonged contact with external air. Within a screw cylinder in the molding machine the thermoplastic resin is melted by heating it up to 250-330° C. using a heater. The mold 6 is maintained at 70-90° C. by means of a separate heater. It should be understood that an injection-molding machine in which pre-drying of the pellet is unnecessary may be employed.

Once the above-described preparations have been finished, the molten resin is ejected through the nozzle 91, directed into the flowpath 611, and the resin flows heading from the first plate 61 to the third plate 63—in particular, heading from a location corresponding to the connector section 22 of the impeller 2, to a location corresponding to the reinforcing ring 23—whereby the cavity interior is filled with resin (step S3). Gas evolving from the resin at the same time that the resin is flowing into the cavity is forced through the evacuation port 631 and exhausted from the cavity via the evacuation passage 632. It will be appreciated that because the infused resin swiftly fills the cavity interior and thereafter hardens rapidly, the mold temperature is adjusted in advance to be 70-90° C. when the resin is being injected.

Utilized as the source material are thermoplastic resins whose principal component is a thermotropic liquid-crystal polymer (here indicating that half or more of the weight is a thermotropic liquid-crystal polymer, and including instances in which the resin is exclusively a thermotropic liquid-crystal polymer), which are resins that excel in fluidity, and have high post-setting strength and outstanding mechanical properties. Specifically, a fully aromatic polyester liquid-crystal polymer to which on the order of 20 weight % fibrous matter such as glass or carbon fiber has been added—a material typified by polyphenylene sulfide (PPS) or Vectra® into which fiberglass has been mixed—is utilized. Furthermore, materials in which PPS and Vectra® are intermixed, or in which other resin(s) are mixed into a thermotropic liquid-crystal polymer, may be utilized.

Notwithstanding that each of the vanes 21 is of slender form, by the exhausting of gases in the cavity interior through the evacuation port 631 formed in a region that corresponds to one end of the plural vanes 21, and by the infusing of molten resin through the gate 612 formed in a region that corresponds to where the other end of the plural vanes 21 is (that is, a region that is associated with the other end), the cavity is appropriately filled with resin to form the vanes 21 in their entirety. Moreover, the reinforcing ring 23, which is molded in parallel with the vanes 21, is formed by the corresponding space inside the mold becoming appropriately filled with resin. It should be understood that, as long as the resin flows for the most part unidirectionally inside the space 651 for the vanes 21, the gate 612 may be formed in another region of the mold 6 that corresponds to where the other end of the plurality of the vanes 21 is—for example, in a region that corresponds to the outer-side surface of the connector section 22 of the impeller 2.

Figure 7:
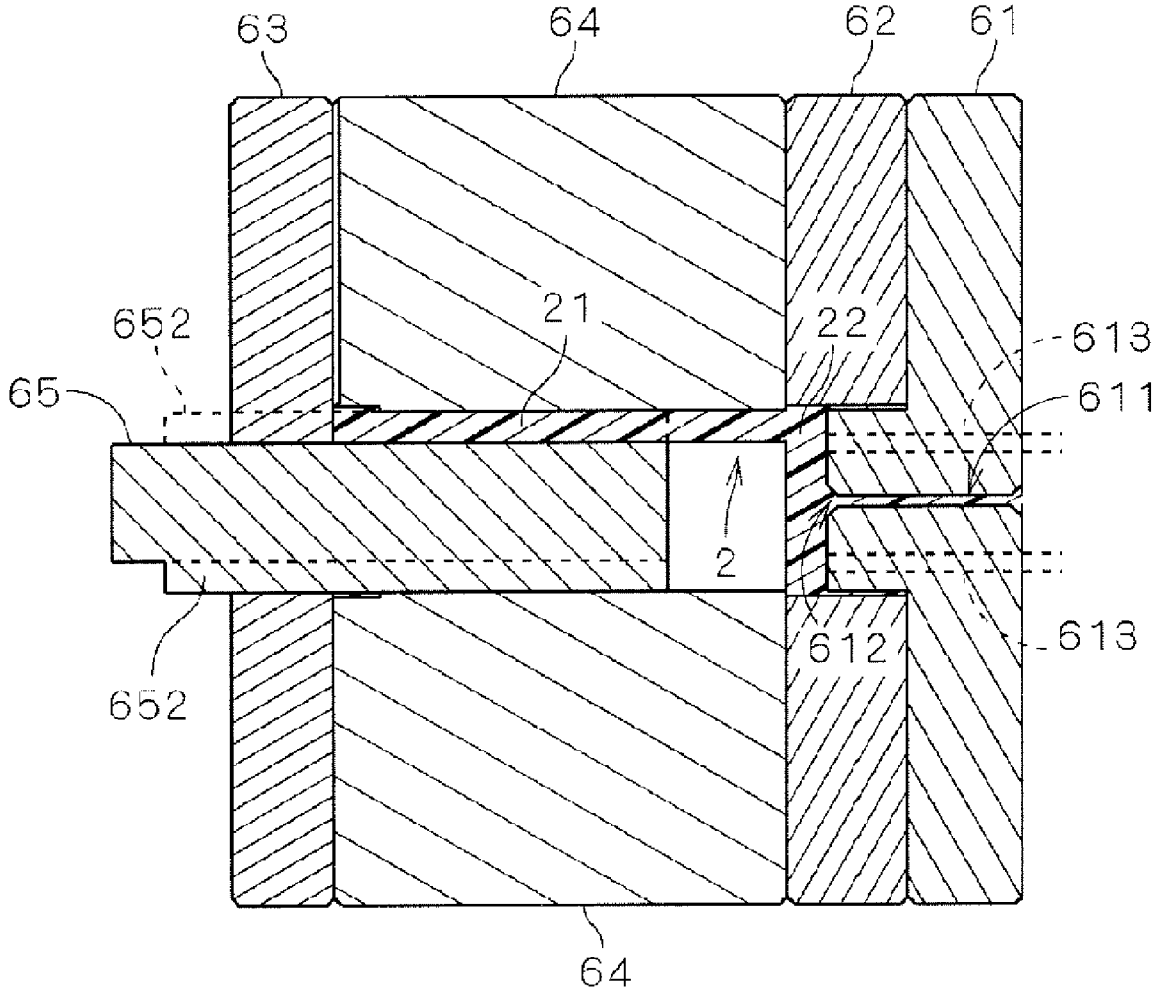
FIG. 7 is a view showing the mold with its core having been drawn out.

After the resin has cooled and set, the molded impeller 2 is taken out of the mold 6 (step S4). Initially, the core 65 is extracted from the third plate 63 and the side blocks 64. FIG. 7 is a sectional view depicting the core 65 having been extracted partway from the mold 6. As described previously, grooves corresponding to the gill-like regions 652 in the core 65 are formed in the third plate 63, wherein twin walls of the grooves define projections that oppose the end face of the vanes 21. Thus the projections block the vanes 21 from being drawn out together with the core 65 when it is being extracted, whereby the vanes 21 remain inside the cavity, sandwiched between the two side blocks 64.

After the core 65 has been extracted the two side blocks 64 are parted slightly, and then by pushing out the connector section 22 of the impeller 2 with a shoving member 613 provided in the vicinity of the flowpath 611 in the first plate 61, the impeller 2 is completely separated from and taken out of the mold 6. In the impeller 2 after having been withdrawn, in a place corresponding to the gate 612, a hole into which a rotor yoke 31 component of the motor 3 fits is formed (c.f. FIG. 1).

Figure 8:
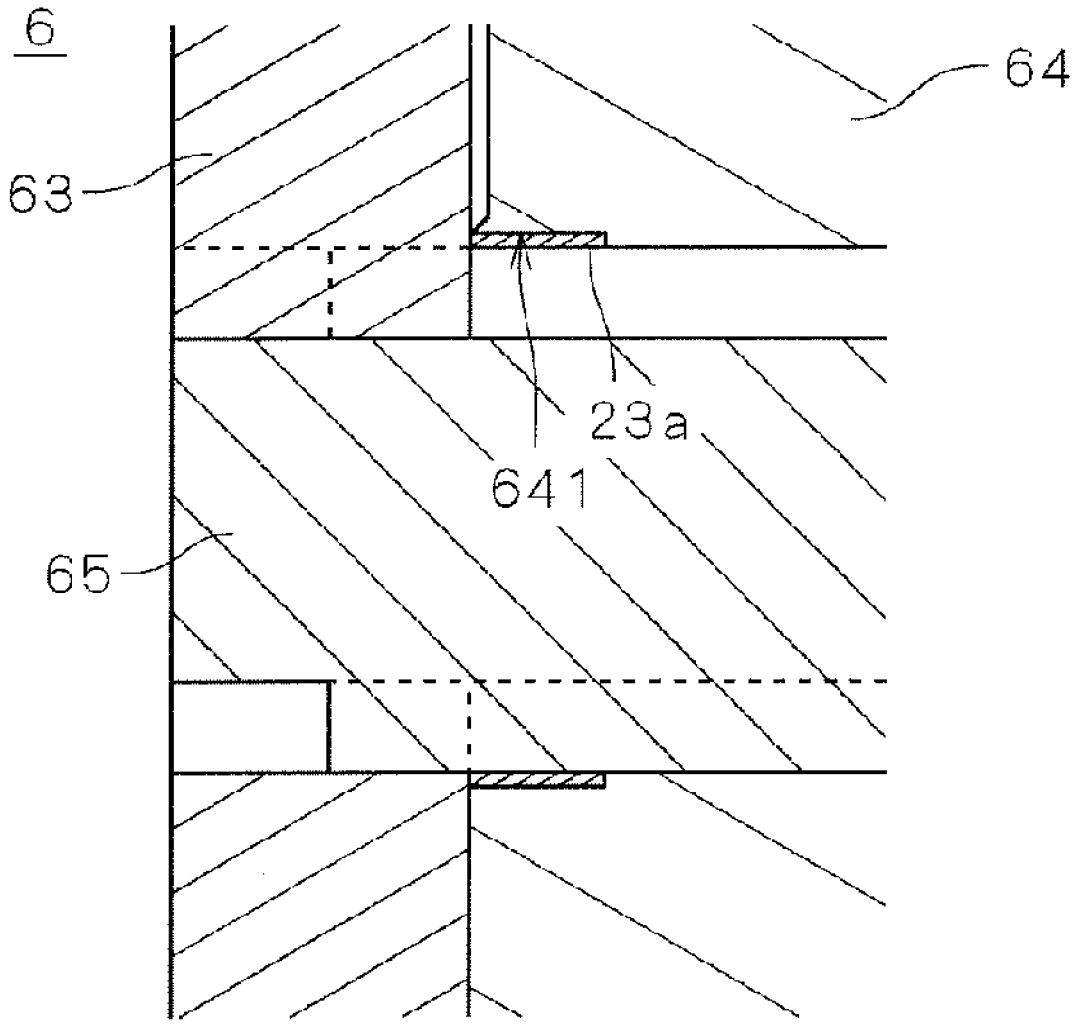
FIG. 8 is a sectional view illustrating a mold in an implementation in which a ring element is used to form a reinforcing ring.

Reference is now made to FIG. 8, which is a sectional view depicting the recess 641 and vicinity, formed by the side blocks 64 and third plate 63 of the mold 6. In this case, with the mold 6 having been set into the injection-molding machine, an approximately round cylindrical metal ring element 23*a*, as illustrated in FIG. 8, is inserted ahead of time into the recess 641, and in that state the cavity interior is evacuated and the resin injected. By having the reinforcing ring 23 be a metal element in insert-molding instances, the strength of the reinforcing ring 23 is enhanced to improve the reliability of the impeller 2.

Figure 9:
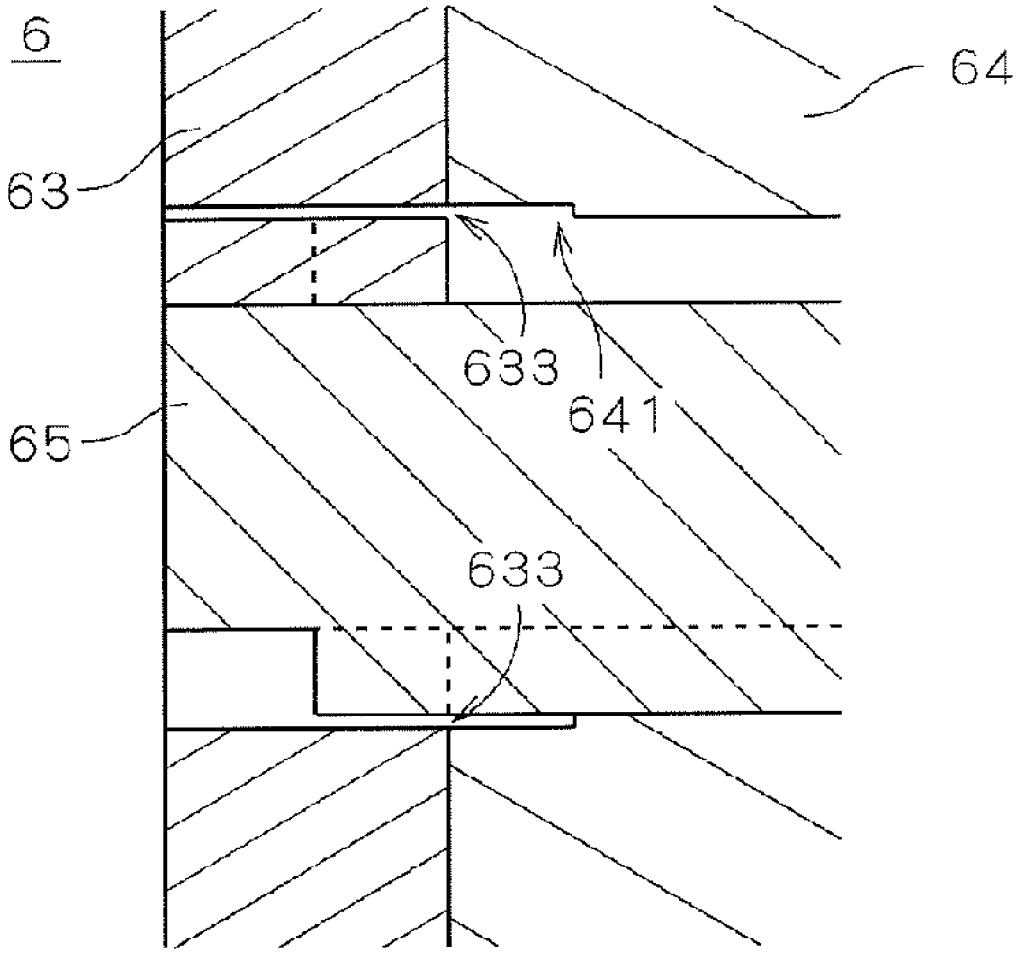
FIG. 9 is a sectional view illustrating another example of a mold.

The description turns now to FIG. 9, which illustrates another example by which the strength of the reinforcing ring 23 is enhanced. In the mold 6 in FIG. 9, apertures 633 are formed in a region that corresponds to the end face of the reinforcing ring 23. Evacuation of the cavity interior is carried out through the apertures 633. The apertures 633 are provided matching the depth of the recess 641, within the third plate 63, or else in between the third plate 63 and the core 65, in a plurality of places running along the annular recess 641. Furnishing the apertures 633 means that when the injection molding operation is carried out, some of the resin that fills the reinforcing ring 23 portion of the mold 6 will overflow through the apertures 633.

In utilizing the mold 6 depicted in FIG. 9 to manufacture an impeller 2, a step of removing the resin that has overflowed through the apertures 633 is added to the last of the manufacturing steps set forth in FIG. 4, that is, after the impeller 2 has been taken out of the mold 6. Resin that has overflowed through the apertures 633 may be removed in the course of taking the impeller 2 out of the mold 6. In that case, before the core 65 is extracted from the impeller vanes, it is advantageous to undo the side blocks 64, and in that state trim the vane tips and the resin portions that are sticking out.

In an implementation in which an impeller is molded in this manner, when the thermoplastic resin melds in the reinforcing ring 23 portion of the cavity, the resin in the vicinity of the meld lines flows fully, improving the joint strength along the meld lines.

Figure 10:
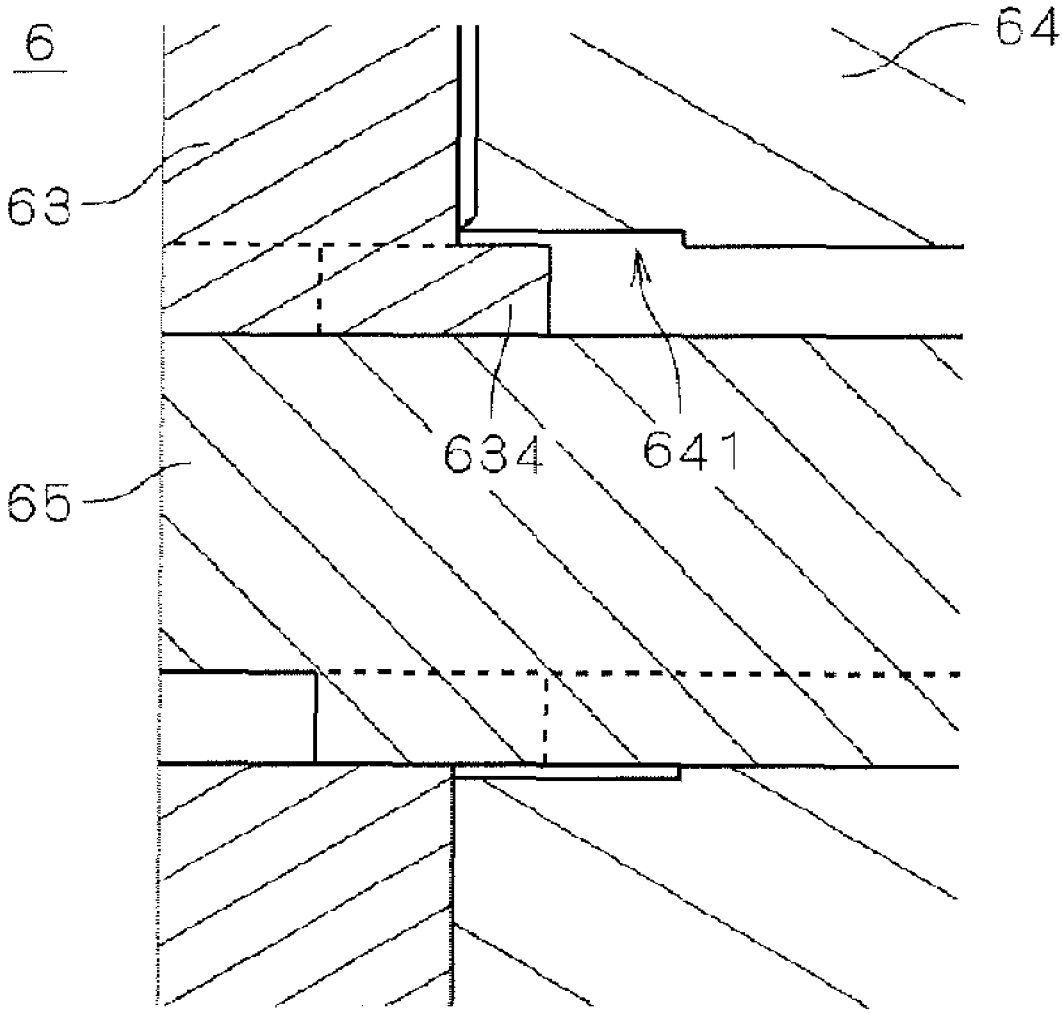
FIG. 10 is a sectional view illustrating yet another example of a mold.

FIG. 10 shows yet another example of a configuration for enhancing the strength of the reinforcing ring 23. In this case, in the mold 6 depicted in FIG. 10, the region in the third plate 63 that opposes the end face of the vanes 21 constitutes a projection 634 that juts out toward the side blocks 64. Put differently, the recess 641 corresponding to the reinforcing ring 23 is elongated in the direction toward the third plate 63. This configuration causes the reinforcing ring 23, molded by evacuating and infusing with resin the interior of the mold cavity, to have a projecting portion that juts out from the ends of the plurality of vanes 21. (C.f. projecting portion 23*b* in later-described FIG. 11B.)

In an implementation of a mold 6 configured as shown in FIG. 10, similarly to the implementation represented in FIG. 9, when the thermoplastic resin melds in the reinforcing ring 23 portion of the cavity, the resin in the vicinity of the meld lines flows fully, by the amount that the recess 641 is elongated, further improving the joint strength along the meld lines.

Figure 11A:
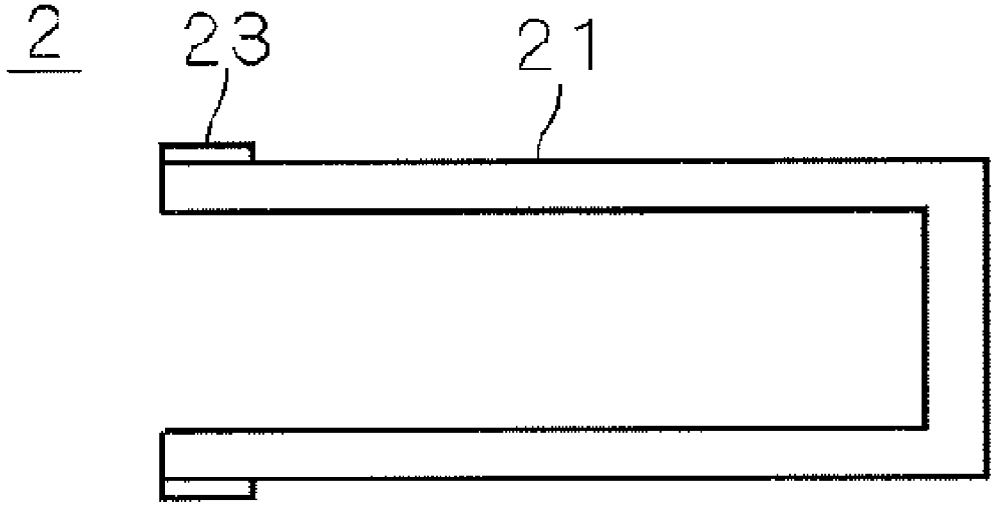
FIGS. 11A-11C are diagrams representing arrangements of the reinforcing ring and the vanes.

Next, the results of actually molding impellers 2 as explained in the foregoing and testing the strength of their reinforcing rings 23 will be described. Table 1 is a tabulation setting forth three types (Characterizations 1 to 3) of injection-molded impeller 2 conformations. The units of length in Table 1 are millimeters. In the test, Vectra® was utilized as the thermoplastic resin, and samples in which, as depicted in FIG. 11A, the end face of the vanes 21 and the end face of the reinforcing ring 23 coincide were fabricated.

TABLE 1

| | Characterization No. | | |
|---|---|---|---|
| | 1 | 2 | 3 |
| Impeller o.d. | 12 | 12 | 12 |
| Number of Vanes | 30 | 34 | 38 |
| Vane max. thickness ft | 0.30 | 0.29 | 0.28 |
| Vane length fL | 23 | 23 | 23 |
| Length/max. thickness | 77 | 79 | 82 |
| Ring thickness rt | 0.50 | 0.50 | 0.50 |
| Vane spacing fp | 1.26 | 1.11 | 0.99 |
| Vane spacing × 2 | 2.52 | 2.22 | 1.98 |

TABLE 1-continued

| | Characterization No. | | |
|---|---|---|---|
| | 1 | 2 | 3 |
| Ring length rL | 2.0 | 4.0 | 4.0 |
| Ring strength | X | ○ | ○ |

In the "Ring strength" column in Table 1, "x" indicates that in taking the impellers 2 out of the mold 6 following the injection-molding operation, there was a 70% or greater likelihood that fracturing in the reinforcing rings 23 would occur, while "○" indicates that there was a less than 10% likelihood. It may be ascertained from the table that with Characterizations 2 and 3, in which the reinforcing rings 23 were made longer, although the thicknesses of the rings were not increased, the reinforcing ring 23 strength was sufficient.

Figure 11B:
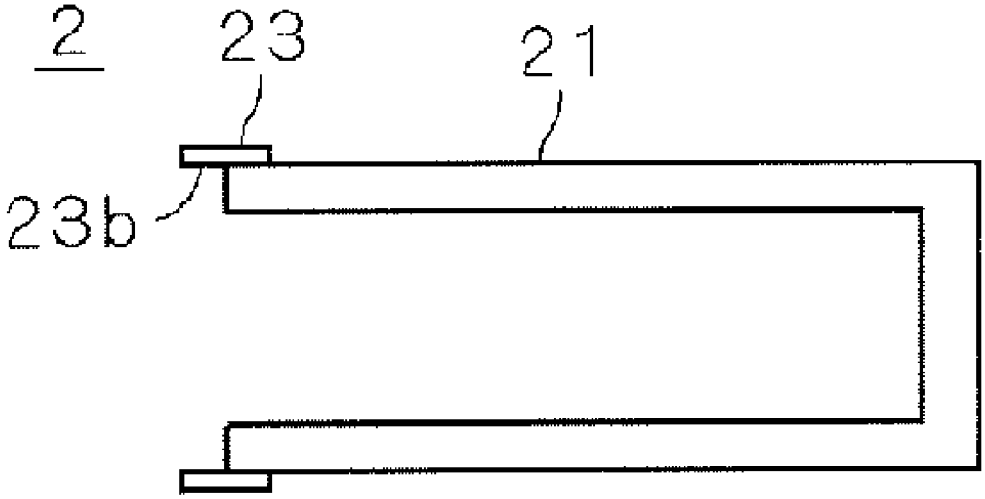
Figure 11C:
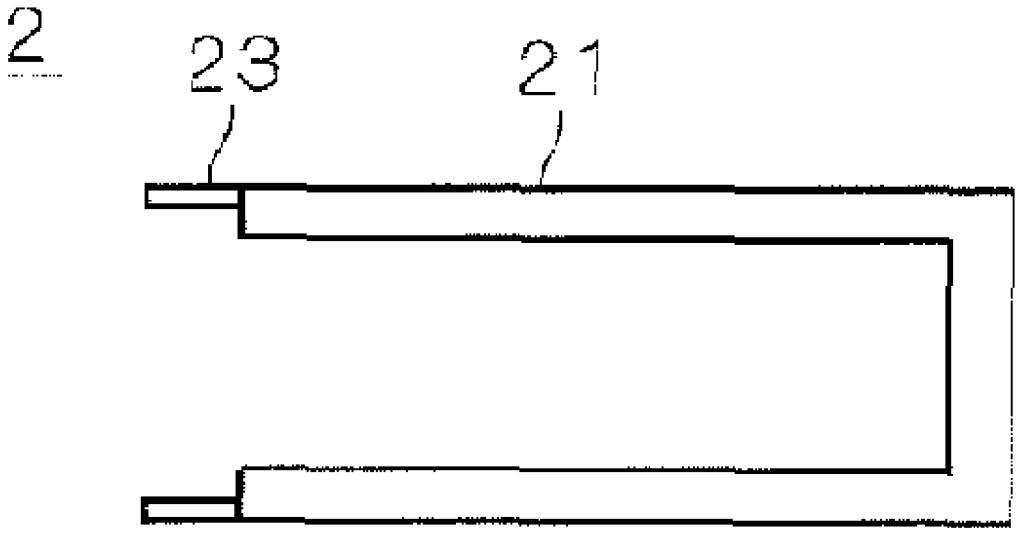

In addition, impellers as shown in FIGS. 11B and 11C—of a form in which part of the reinforcing ring 23 jutted out from the vanes 21, and of a form in which the reinforcing ring 23 was connected to the end face of the vanes 21—were fabricated under Characterization 3 in Table 1. In these implementations as well, the incidence of fracturing in the reinforcing ring in taking the impeller out of the mold was less than 10%, and thus strength in the reinforcing rings was secured.

Here, by having the length of the projecting portion 23*b*, which from the ends of the vanes 21 juts out paralleling the center axis 10, of reinforcing rings 23 in the FIG. 11B implementation be 1.5 times the pitch fp of the vanes 21, the resin flowing out from the flutes 651 that correspond to the vanes 21 flows sufficiently into the extension portion of the reinforcing ring 23, whereby sufficient strength along the meld lines is secured. (C.f. FIG. 10.)

In molding applications in which articles of extremely slender conformation are injection-molded, as is the case with the vanes of impellers 2 of the present invention, thermotropic liquid-crystal polymers of long flow length are often employed as the molded material. Thermotropic liquid-crystal polymers during molding exhibit strong anisotropy in terms of the resin flow direction, such that degradation in strength along meld lines is serious. Utilizing the present invention, however, averts compromised strength along meld lines that form in the reinforcing ring, to enable high-strength impellers to be produced.

Figure 12:
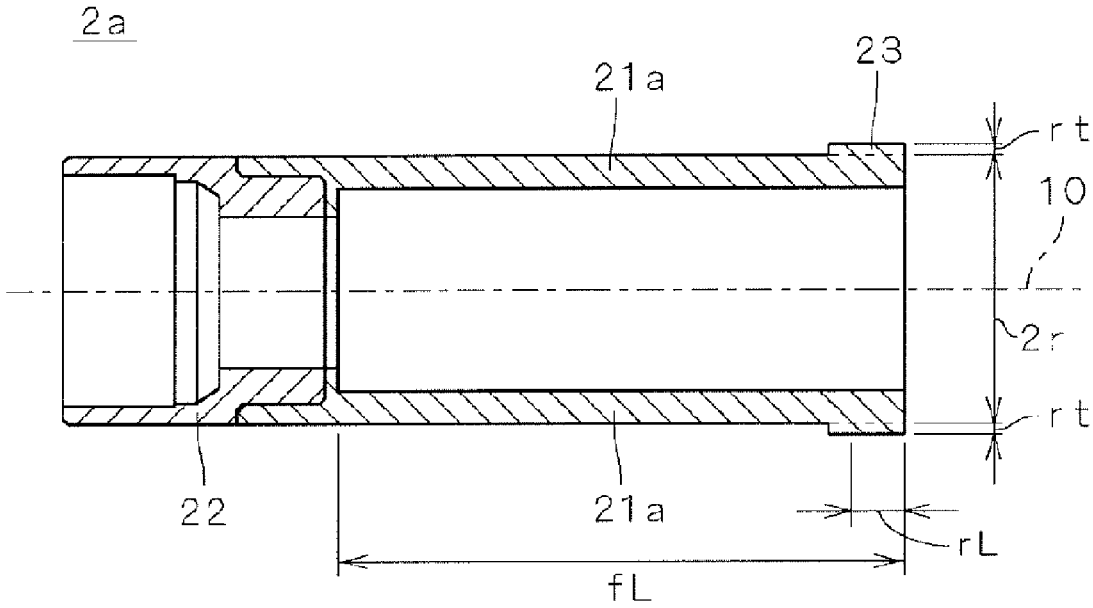
FIG. 12 is a vertical section view illustrating a centrifugal-fan impeller involving a second embodiment of the present invention.
Figure 13:
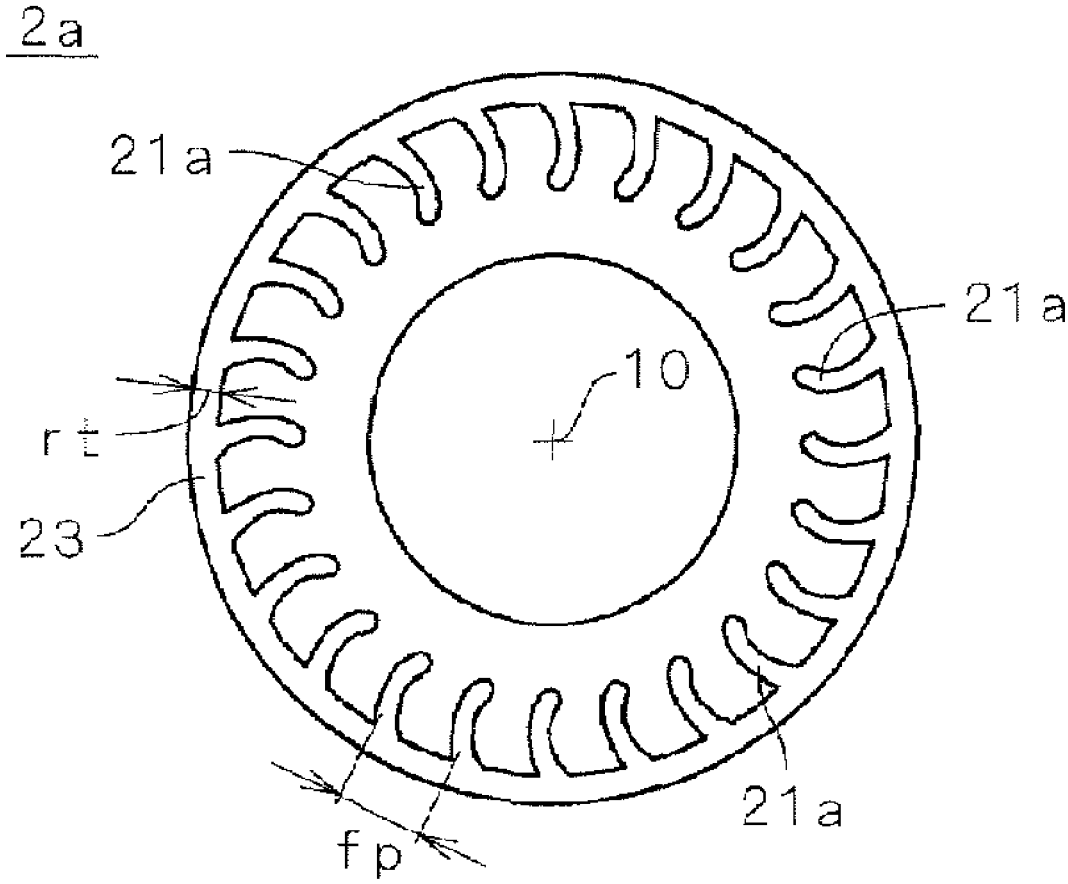
FIG. 13 is view illustrating the impeller of FIG. 12 from a lateral aspect.
Figure 14:
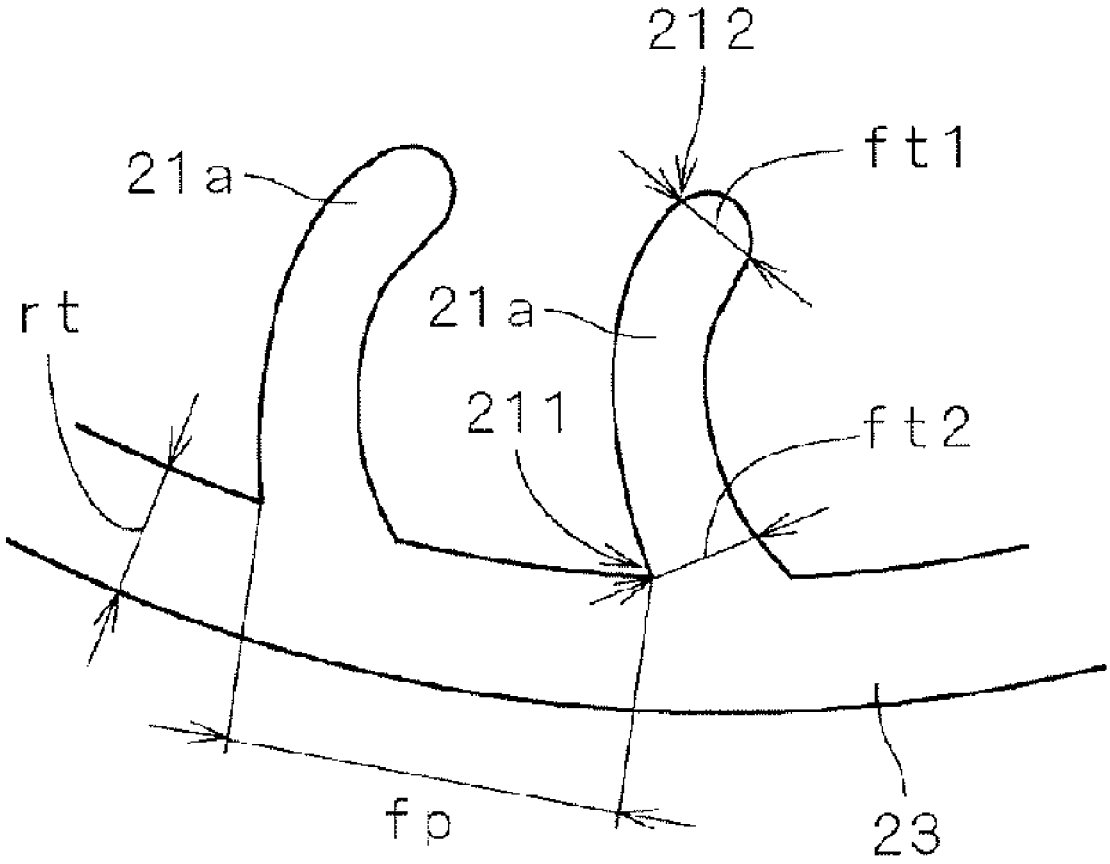
FIG. 14 is an enlarged fragmentary view showing details of the impeller as shown in FIG. 13.

Next, referring to FIGS. 12-14, an explanation of a centrifugal fan involving a second mode of embodying the present invention will be made. FIG. 12 is a vertical section view illustrating a centrifugal fan impeller 2*a*, sliced through a plane containing the fan's center axis 10, involving a second embodiment of the present invention. FIG. 13 is lateral-aspect diagram of the impeller 2*a* seen from the right side in FIG. 12, looking toward the left; and FIG. 14 is diagram in which a portion of the impeller 2*a* as depicted in FIG. 13 is shown enlarged. As illustrated in FIG. 13, in a centrifugal fan involving the second embodiment, a plurality of vanes 21*a* having a transverse cross-sectional form that differs from that of the plurality of vanes 21 depicted in FIG. 3 is provided in the impeller 2*a*. Apart from this feature, the configuration is similar to that of FIG. 1 through FIG. 3, and thus in the following illustration, the same reference marks will be appended.

With the exception of being furnished with the impeller 2*a* depicted in FIGS. 12-14, a centrifugal fan involving the second embodiment is similar to that of FIG. 1, and thus the structure and form of the motor 3 and housing 4 are the same as that shown in FIG. 1 through FIG. 3. The plural vanes 21*a*, the connector section 22, and the reinforcing ring 23 are molded unitarily from a thermoplastic resin whose principal component is a thermotropic liquid-crystal polymer. In FIGS. 13 and 14 also, likewise as in FIG. 3, the pitch of the plural vanes 21*a* is labeled with reference mark fp, and the impeller 2*a* outer diameter is labeled with reference mark 2*r*.

In the impeller 2*a*, as indicated in 14, along each of the plural vanes 21*a* the thickness ft2 of the region (called "ring joint" hereinafter) 211 connected to the reinforcing ring 23 is thicker than the thickness dimension of the rest of the vane 21*a*, wherein each vane 21*a* gradually diminishes in thickness as the dimension parts away from the reinforcing ring 23. Thus the minimum thickness ft1 is in the verges 212 at the inner-peripheral side of the vanes 21*a*, (with the roundness attendant on rounding off the vane edges not being deemed thickness).

The process flow in manufacturing the impeller 2*a* by injection molding is the same as the flow, set forth in FIG. 4, for manufacturing the impeller 2 involving the first embodiment, and the configuration of the mold employed in manufacturing the impeller 2*a*, except for the conformation of the cavity corresponding to the vanes 21*a*, is also the same as that of the mold 6 depicted in FIG. 5.

Next, the results of molding impellers 2*a* and testing the strength of their reinforcing rings 23 will be described. Table 2 is a tabulation setting forth two types (Characterizations 4 and 5) of injection-molded impeller 2*a* conformations, and as a comparative example, entered together with these characterizations is the impeller 2 conformation of Characterization 1 set forth in Table 1. In the test, Vectra® was utilized as the thermoplastic resin, and samples in which, in the same way as is the case with the vanes 21 and reinforcing ring 23 depicted in FIG. 11A, the end face of the vanes 21*a* and the end face of the reinforcing ring 23 coincide were fabricated.

TABLE 2

| | Characterization No. | | |
|---|---|---|---|
| | 1 | 4 | 5 |
| Impeller o.d. | 12 | 12 | 5.4 |
| Number of Vanes | 30 | 34 | 24 |
| Vane thickness ft1 | 0.30 | 0.29 | 0.17 |
| Vane thickness ft2 | 0.30 | 0.35 | 0.20 |
| Vane length fL | 23 | 23 | 9.5 |
| Length/max. thickness | 77 | 66 | 48 |
| Ring thickness rt | 0.50 | 0.50 | 0.25 |
| Vane spacing fp | 1.26 | 1.11 | 0.7 |
| Vane spacing × 2 | 2.52 | 2.22 | 1.4 |
| Ring length rL | 2.0 | 4.0 | 1.5 |
| Ring strength | X | ○ | ○ |

In the "Ring strength" column in Table 2, like in Table 1, "x" indicates that in taking the impellers 2*a* out of the mold 6 following the injection-molding operation, there was a 70% or greater likelihood that fracturing in the reinforcing ring would occur, while "○" indicates that there was a less than 10% likelihood. The units of length in Table 2 are also millimeters.

From the results of the test it may be ascertained that with the impellers 2*a* of Characterizations 4 and 5, in which the thickness of the vanes 21*a* gradually diminishes the further away from the reinforcing ring 23 the measurement is (that is, the characterizations in which ft1 is smaller than ft2), the reinforcing rings 23 had sufficient strength.

Although methods of manufacturing centrifugal fans and impellers involving modes of embodying the present invention have been explained in the foregoing, in that various modifications of the present invention are possible, the invention is not limited to the embodiments described above.

For example, in the foregoing embodiments, examples were set forth in which prior to the injection molding operation the cavity in the mold 6 was evacuated to bring it into a vacuum state, but the evacuation may be carried out in parallel, for the most part, with the molding operation. Additional examples are that in the third side plate 63 a minute evacuation port may be formed to carry the evacuation out through a position corresponding to the end face of the reinforcing ring 23, and that the minute evacuation port may be formed in the base of the recess 641 corresponding to the reinforcing ring 23.

In any of the examples of FIG. 5 and FIG. 8 through FIG. 10, the reinforcing ring 23 may join the plurality of vanes 21 along the inner side of the vanes 21 (the same being true of the vanes 21*a* and reinforcing ring 23 of the second embodiment). Also, in the FIG. 9 implementation, in which a portion of the resin for the reinforcing ring 23 overflows, the direction in which the resin overflows does not have to be parallel to the center axis, but may be perpendicular to the center axis. And the opening through which the resin overflows may be formed in a position corresponding to the lateral (cylindrical) surface of the reinforcing ring 23.

In the implementation illustrated in FIG. 10, from the perspective of facilitating reduction of the outer diameter of the reinforcing ring 23, it is preferable that the projecting portion 23*b* (c.f. FIG. 11) be formed parallel to the center axis, but the projecting portion may be rendered in a form in which it expands outward or projects inward from the reinforcing ring 23.

What is claimed is:

1. A centrifugal-fan impeller comprising:

a plurality of vanes each parallel to a center axis and arrayed encompassing the center axis so that the vane outer radius 2*r* is no more than 25 mm and so as to be spaced apart at a predetermined pitch, said vanes being of less than 0.7 mm maximum thickness, and of length fL satisfying $2 \leqq fL/r \leqq 20$ and exceeding 40 times said maximum thickness; and an approximately round cylindrical reinforcing ring linking one end of said plurality of vanes, said reinforcing ring having a diametrical thickness of from ½ to 3 times said maximum thickness of each of said plurality of vanes, and as measured along the center axis, having a length at least 2 times the pitch of said plurality of vanes; wherein said plurality of vanes and said reinforcing ring linking the vanes at one end are formed unitarily by injection molding; and the thickness of each of said plurality of vanes in the region where each is connected to said reinforcing ring is said maximum thickness.

2. A method of manufacturing a centrifugal-fan impeller as set forth in claim 1, the centrifugal fan manufacturing method comprising:

a mold-preparation step of preparing a mold having a cavity matching the conformation of said centrifugal-fan impeller;

a mold-evacuation step of evacuating gas inside the cavity, through an evacuation port formed in the mold in the vicinity of a region corresponding to said one end of said plurality of vanes;

a resin-infusion step, either following or concurrently with said mold-evacuation step, of infusing a molten resin into the mold through a gate formed in the mold in a region corresponding to where the other end of said plurality of vanes is; and a removal step of taking the molded centrifugal-fan impeller out of the mold.

3. A centrifugal-fan impeller manufacturing method as set forth in claim 2, wherein:

an opening is formed in the mold in a region corresponding to either an end face or the cylindrical surface of said reinforcing ring, so that in said resin-infusion step, some of the resin being infused into the mold overflows through the opening; and either simultaneously with or following said removal step, resin having overflowed through said opening is removed.

4. A centrifugal-fan impeller manufacturing method as set forth in claim 3, wherein the site in which said evacuation port is formed in the mold is in a recess corresponding to said reinforcing ring and corresponds to either the end face or cylindrical surface of said reinforcing ring.

5. A centrifugal-fan impeller manufacturing method as set forth in claim 2, wherein the site in which said evacuation port is formed in the mold is in a recess corresponding to said reinforcing ring and corresponds to either the end face or cylindrical surface of said reinforcing ring.

6. A centrifugal-fan impeller comprising:

a plurality of vanes each parallel to a center axis and arrayed encompassing the center axis so that the vane outer radius 2*r* is no more than 25 mm, said vanes being of less than 0.7 mm maximum thickness, and of length fL satisfying $2 \leqq fL/r \leqq 20$ and exceeding 40 times said maximum thickness, and being formed by injecting into a mold and molding thermotropic liquid-crystal polymer in a fluid state; and an approximately round cylindrical reinforcing ring linking one end of said plurality of vanes, said reinforcing ring being integrally cohered with said vanes by setting a ring element within the mold in advance of molding said plurality of vanes.

7. A method of manufacturing a centrifugal-fan impeller having a plurality of vanes each parallel to a center axis and arrayed encompassing the center axis so that the vane outer radius 2*r* is no more than 25 mm and so as to be spaced apart at a predetermined pitch, said vanes being of less than 0.7 mm maximum thickness, and of length fL satisfying $2fL/r \leqq 20$ and exceeding 40 times said maximum thickness; and an approximately round cylindrical reinforcing ring linking one end of said plurality of vanes, said reinforcing ring having a diametrical thickness of from ½ to 3 times said maximum thickness of each of said plurality of vanes, and as measured along the center axis, having a length at least 2 times the pitch of said plurality of vanes, wherein said plurality of vanes and said reinforcing ring linking the vanes at one end are formed unitarily by injection molding, the method comprising:

a mold-preparation step of preparing a mold having a cavity matching the conformation of said centrifugal-fan impeller;

a mold-evacuation step of evacuating gas inside the cavity, through an evacuation port formed in the mold in the vicinity of a region corresponding to said one end of said plurality of vanes;

a resin-infusion step, either following or concurrently with said mold-evacuation step, of infusing a molten resin into the mold through a gate formed in the mold in a region corresponding to where the other end of said plurality of vanes is; and a removal step of taking the molded centrifugal-fan impeller out of the mold.

8. A centrifugal-fan impeller manufacturing method as set forth in claim 7, wherein:

an opening is formed in the mold in a region corresponding to either an end face or the cylindrical surface of said reinforcing ring, so that in said resin-infusion step, some of the resin being infused into the mold overflows through said opening; and either simultaneously with or following said removal step, resin having overflowed through said opening is removed.

9. A centrifugal-fan impeller manufacturing method as set forth in claim 8, wherein the site in which said evacuation port is formed in the mold is in a recess corresponding to said reinforcing ring and corresponds to either the end face or cylindrical surface of said reinforcing ring.

10. A centrifugal-fan impeller manufacturing method as set forth in claim 7, wherein the site in which said evacuation port is formed in the mold is in a recess corresponding to said reinforcing ring and corresponds to either the end face or cylindrical surface of said reinforcing ring.

11. A method of manufacturing a centrifugal-fan impeller having a plurality of vanes each parallel to a center axis and arrayed encompassing the center axis so that the vane outer radius 2*r* is no more than 25 mm and so as to be spaced apart at a predetermined pitch, said vanes being of less than 0.7 mm maximum thickness, and of length fL satisfying $2 \leqq fL/r \leqq 20$ and exceeding 40 times said maximum thickness; and an approximately round cylindrical reinforcing ring linking one end of said plurality of vanes, said reinforcing ring having a diametrical thickness of from ½ to 3 times said maximum thickness of each of said plurality of vanes, and as measured along the center axis, having a length at least 2 times the pitch of said plurality of vanes; wherein said plurality of vanes and said reinforcing ring linking the vanes at one end are formed unitarily by injection molding; and said reinforcing ring has a projecting portion projecting from one end of said plurality of vanes; the method comprising:

a mold-preparation step of preparing a mold having a cavity matching the conformation of said centrifugal-fan impeller;

a mold-evacuation step of evacuating gas inside the cavity, through an evacuation port formed in the mold in the vicinity of a region corresponding to said one end of said plurality of vanes;

a resin-infusion step, either following or concurrently with said mold-evacuation step, of infusing a molten resin into the mold through a gate formed in the mold in a region corresponding to where the other end of said plurality of vanes is; and a removal step of taking the molded centrifugal-fan impeller out of the mold.

* * * * *